United States Patent [19]

Phillips

[11] 4,448,350

[45] May 15, 1984

[54] RAILROAD TRACK STRESS TRANSFER APPARATUS

[76] Inventor: Albert A. Phillips, P.O. Box 56A, Byars, Okla. 74831

[21] Appl. No.: 406,049

[22] Filed: Aug. 6, 1982

[51] Int. Cl.[3] ..... E01B 11/08

[52] U.S. Cl. ..... 238/231; 238/14.4; 238/292; 248/71

[58] Field of Search ..... 238/14.05, 14.2, 14.4, 238/14.7, 14.14, 171, 173, 203, 205, 207, 218, 223–225, 227, 228, 230, 231, 234, 292, 304, 349, 201, 204, 282, 333, 336, 347; 248/71

[56] References Cited

U.S. PATENT DOCUMENTS

| | | | |
|---|---|---|---|
| 675,645 | 6/1901 | Wood | 238/225 |
| 708,908 | 9/1902 | McLin | 238/225 |
| 731,181 | 6/1903 | Hever | 238/228 X |
| 750,736 | 1/1904 | Urbanitzky | 238/218 X |
| 1,043,645 | 11/1912 | Todd | 238/225 |
| 1,067,973 | 7/1913 | Cooke | 238/227 |
| 1,358,535 | 11/1920 | Fisk | 238/304 |
| 1,640,791 | 8/1927 | McGinley | 238/225 |
| 1,992,341 | 2/1935 | Woodings | 238/349 |
| 2,008,946 | 7/1935 | Cooper | 238/304 |
| 2,155,189 | 4/1939 | Heinrich | 248/71 |

FOREIGN PATENT DOCUMENTS

| | | | |
|---|---|---|---|
| 1004199 | 1/1977 | Canada | 238/228 |
| 73941 | 9/1893 | Fed. Rep. of Germany | 238/292 |

*Primary Examiner*—Randolph Reese

*Attorney, Agent, or Firm*—Browdy and Neimark

[57] ABSTRACT

A double tongue and groove rail expansion assembly is provided with ancillary equipment to limit dimensional flexing of a railroad track caused by instabilities in the underlying earthen surface, or variable work loads, or temperature changes effecting the longitudinal dimensions of the rails, or any and all combinations of such stresses. The ancillary equipment includes pushover assemblies for control of lateral and vertical forces, tieplate assemblies for control of longitudinal and vertical forces and an electrical bonding system to maintain electrical balance across the area of rail joinment.

11 Claims, 10 Drawing Figures

RAILROAD TRACK STRESS TRANSFER APPARATUS

FIELD OF THE INVENTION

The present invention relates to an improvement for railroad track rails, ties and associated bedding provisions.

BACKGROUND OF THE INVENTION

The railroad industry, because of its time extensive nature, is inherently resistant to quick fixes presented by untested technological changes. Railroad tracks and rolling equipment are effected by a variety of subtle factors made important by the repetitive nature of the industry.

Those of normal skill in the railroad industry are those who are particularly qualified in the art of discernment and recognize that subtle and hard to identify factors are more important to this industry than they may be in other industries. Those of less than ordinary skill in the field of concern may fail to recognize the subtle factors of importance and assume that some particular improvement may make another improvement obvious when, in fact, those of ordinary skill would recognize such change as highly innovative.

One of the more perplexing problems that the railroad industry has learned to live with relates to interfacing a track system needing dimensional stability with a supporting surface which is dimensionally unstable. The developed technology generally calls for bedding material, called ballast, to be placed on a prepared earthen surface; ties to be placed on the bedding material; and rails atttached to the ties. Ideally the system is structured so that relative motion between the surface, the bedding material and the ties is absorbed in a manner that leaves the rails parallel and neither warped nor humped. Some of the relative motion results from weather factors effecting the supportive surface and other relative motion results from imposed work loads. The imposed stresses are of repetitive nature and, like water wearing away stone, the system erodes with time.

The weather factors that influence supporting surface movement include a 22 year drought and flood cycle, seasonal changes with an annual cycle and, within each seasonal cycle, a day/night change. Local weather can, in a few minutes and in a distance of a few hundred yards, combine the extremes of the 22 year cycle, the annual cycle and the daily cycle into one brief occurance.

Severe thunderstorms have been known, for example, to bury one section of track under icy hail with the surface awash due to run-off rain; and leave the adjoining section of track resting on a dry, hard packed surface with the rails exposed to the scorching heat of the sun. Thus the weather variables may be experienced over a period of almost a quarter century or within minutes.

Technological changes relative to railroad rolling stock as well as track systems also produce many variable and subtle effects. Track wear patterns have changed as different alloys of metal have been introduced. Other subtle changes have resulted in the change from steam driven locomotives to diesel engines; as passenger trains have been phased out in favor of freight trains; as operational speeds have been varied; and as changes in decelerative techniques have been made. Expansive details on the Background of the Invention can be found in U.S. patents in Class 238 and related classes. Pursuit of such details reveal that many piecemeal solutions have been tried and found wanting but a long felt need exists for synergistic solutions. In particular there is a long felt need to accomodate longitudinal changes in rail length, brought about by temperature changes, without introducing stresses that result in lateral warping or vertical humping which introduce failure factors to the underlying supportive surface.

To be truly synergistic the accomodations for the result of temperature changes should also be responsive to wear factors felt by rolling stock, tracks, ties and bedding material. Those of normal skill in the field of concern will appreciate the fact that subtle nuances within the technology do much to seperate the obvious improvements from those which are not.

SUMMARY OF THE INVENTION

The instant invention provides a system whereby the railroad industry can easily and feasibly install and repair their rail systems, with respect to both straight and curved tracks, and this is accomplished in an economical manner to provide a safer track bed. My U.S. Pat. No. 4,260,105, issued Apr. 7, 1981, for a Railroad Tie Plate and Correctable Shim addresses different aspects of the same problem.

An object of the invention is to accomodate longitudinal dimensional changes in rail segments in a manner which alleviates the battering action between rail ends and rolling wheels when there is a gap between rails or the ends of the rails are vertically misaligned.

An additional object is to lessen the torque force applied to ties because of movement of the rails inspired by temperature effects, or the wave like motion of the rails caused by the stresses of moving wheel contact, or the equal and opposite longitudinal force felt by the rails when the work load supported by the rails is either accelerated or decelerated.

An additional object is to lessen the torque force applied to the rails by centripetal and centrifugal forces acting laterally upon the rails of curved track.

An additional object is to keep the contact area between tie surfaces and bedding material at a maximum so that stresses are passed from the overlying track to the underlaying surface with minimal wear factors.

An additional object is to maintain electrical bondage between the ends of adjoining rail segments despite the longitudinal movement of the rails inspired by temperature changes and other movements related to work load stresses and movements within the supportive surface.

Another object is to configure the apparatus so that a lag screw type fastening means can provide tensional adjustments to preserve the synergistic nature of the apparatus as various subtle factors are experienced over the extended lifetime of the installation.

Other objects of the invention are incorporated into other parts of the specifications and claims.

BRIEF DESCRIPTION OF THE DRAWINGS

FIG. 4A is an end view of FIG. 4.

FIG. 4B is a side view of FIG. 4.

FIG. 5A is an end view of FIG. 5.

FIG. 5Bis a side view of FIG. 5.

DESCRIPTION OF THE PREFERRED EMBODIMENT

Figure 1:
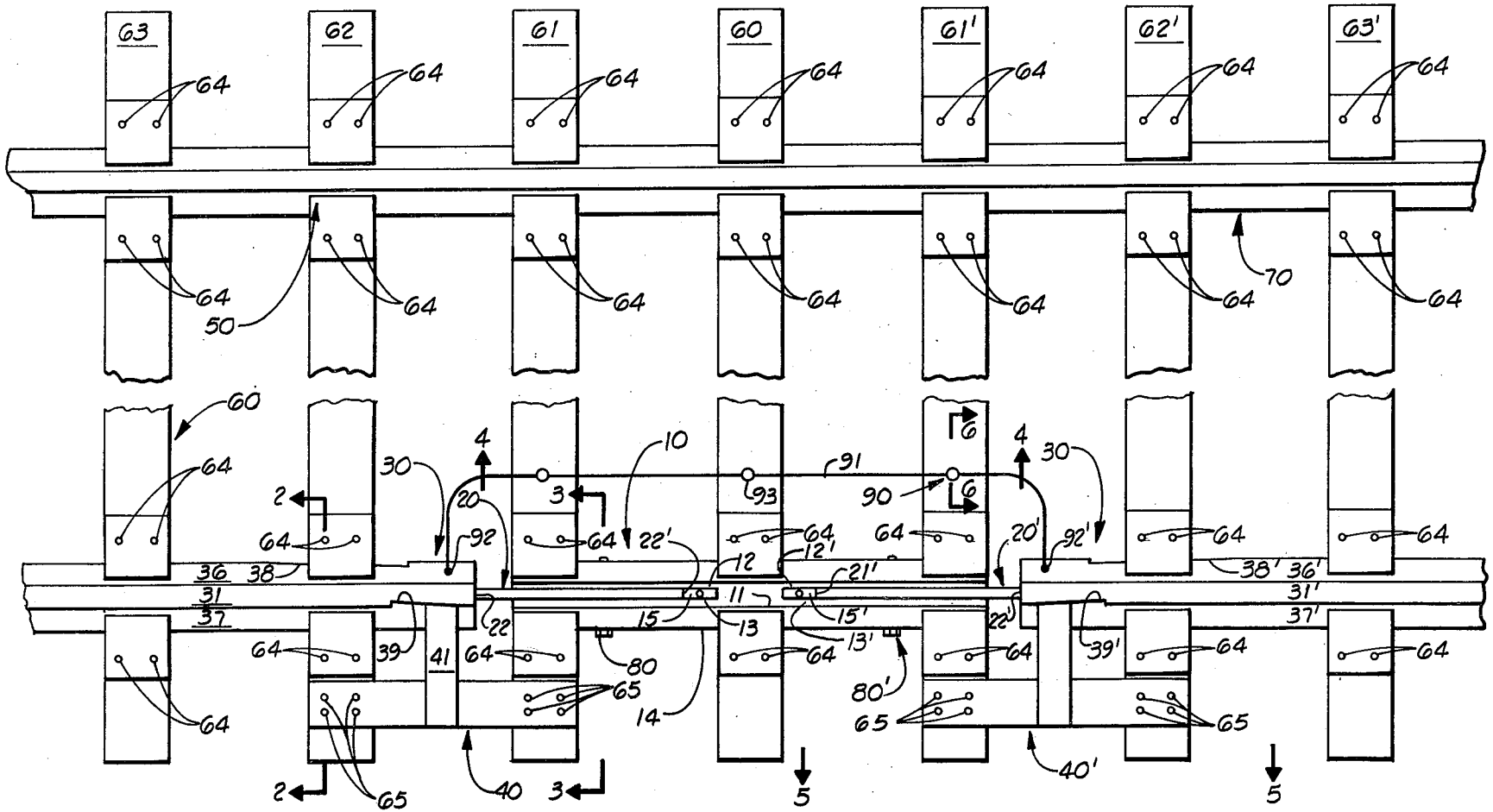
FIG. 1 is a top view of a railroad track section using components of the instant invention.

As seen in FIG. 1 a longitudinally extensive double grooved frame member 10 slidably encompasses a first tongue member 20 and a second tongue member 20'. The first tongue member 20 is rigidly attached to a first railend 30 and the second tongue member 20' is rigidly attached to a second railend 30'. A first pushover assembly 40 is positioned in slidable contact with the railend 30 and a second pushover assembly 40' is positioned in slidable contact with the railend 30'. A plurality of tieplate assemblies 50 function as fastening means and attach to crossties 60, 61, 61', 62, 62', 63 and 63'. A continuous rail 70 parallels the longitudinally extensive railends 30 and 30'. A first safety bolt assembly 80 maintains the slidable tongue member 20 within a groove 15 and a second safety bolt assembly 80' maintains the slidable tongue member 20' within a second groove 15'. An electrical bondage assembly 90 maintains electrical equivalency between the first railend 30 and the second railend 30'. The disclosed apparatus can be categorized as a double tongue and groove rail expansion joint with ancillary equipment.

Figure 4:
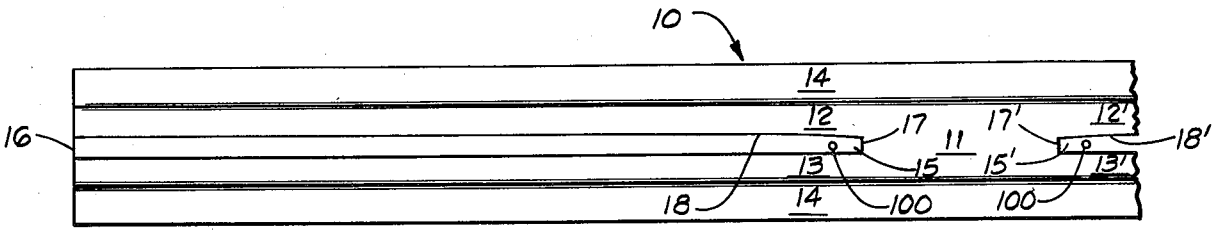
FIG. 4 is a partial length top view of the isolated frame member component taken within the extension 4—4 shown in FIG. 1.

It is to be recognized that the FIG. 1 drawing is illustrative of typical track component configurations and that such components are dimensionally variable within the standards of the industry. The components of the instant invention are intended to interface with such track components. Dimensional variations of the preferred embodiment are not shown as alternative embodiments, nor deemed necessary, and it is to be recognized that any such variations would not alter the scope of the invention. As can be seen in FIGS. 4, 4A and 4B the double grooved frame member 10 has a central solid section 11 and extending therefrom a first inner wall 12, a second inner wall 12', a first outer wall 13 and a second outer wall 13'; all being extensions from a horizontal base flange 14 and forming the groove 15 having a first open end 16 and a closed end 17 with the second groove 15' having a second open end 16' and a second closed end 17'. A first deflective ramp 18 is formed within the first groove 15 and a second deflective ramp 18' is formed within the second groove 15'.

Figure 5:
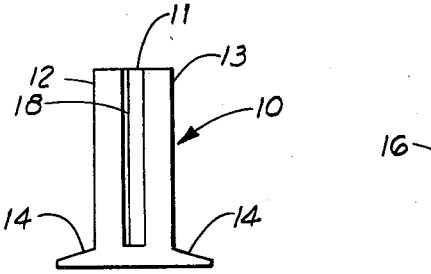
FIG. 5 is an isolated partial length top view of one of two tongue member/railend assemblies, which are mirror images of each other, taken within the extension 5—5 shown in FIG. 1.
Figure 4:
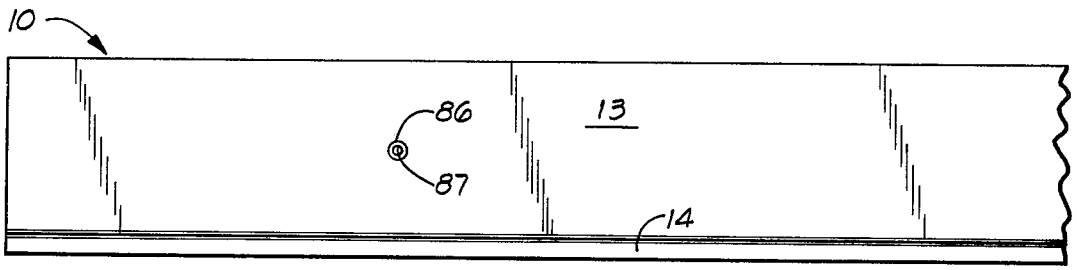
Figure 7:
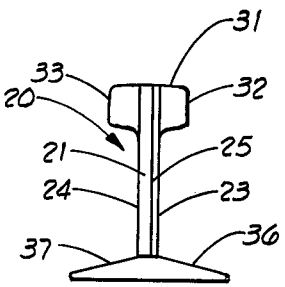

As can be seen in FIGS. 5, 5A and 5B the first tongue member 20 has a free end 21, an attachment end 22, an inward surface 23, an outward surface 24, a clearance ramp 25 and the attachment end 22 is rigidly secured to the railend 30. The second tongue member 20' has similar provisions and is attached to the second railend 30'.

The first railend 30 has a railhead 31, a railhead inner vertical surface 32, an outer vertical surface 33, a railhead lower surface 34, a vertically extensive web 35, an inner base flange 36 and an outer base flange 37 forming a single component part. A base flange clearance ramp 38 is cut from the inner base flange 36 and a railhead deflective ramp 39 is cut from the railhead outer vertical surface 33. As can be seen in FIG. 1 the second railend 30' has similar provisions.

Figure 2:
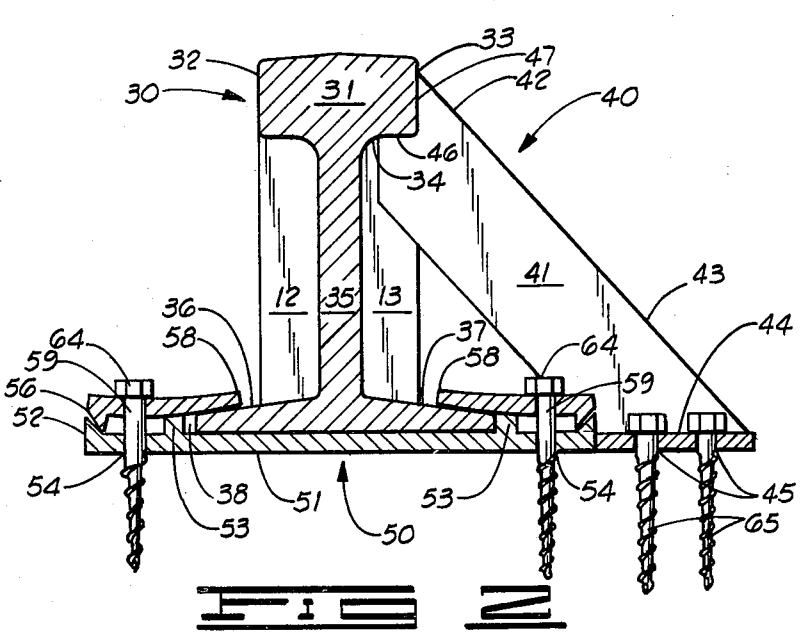
FIG. 2 is a cross sectional end view taken along the plane 2—2 shown in FIG. 1.
Figure 3:
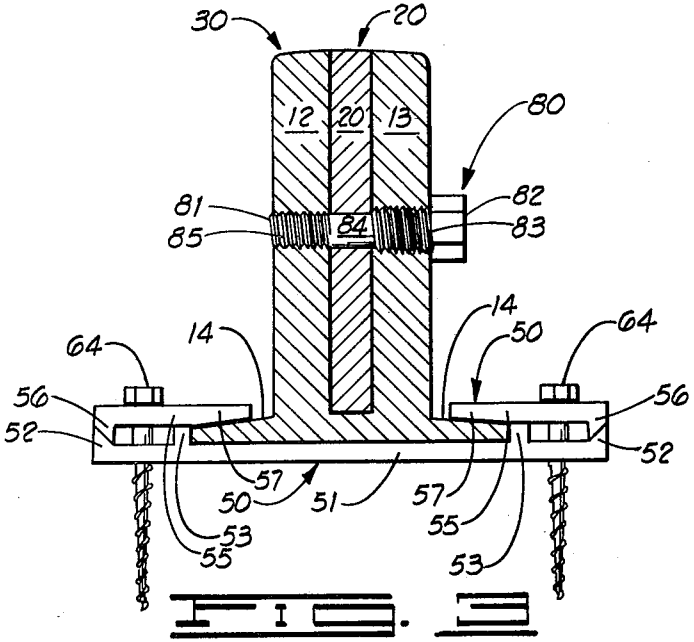
FIG. 3 is a cross sectional end view taken along the plane 3—3 shown in FIG. 1.

As can been seen in FIG. 2 the first pushover assembly 40 has a thrust arm 41 with a rail contact end 42 and a lower end 43 extending from a base bridgement plate 44 with apertures 45 formed therein. As can be seen in FIG. 1 the second pushover assembly 40' has similar provisions. Returning to FIG. 2, it can be seen that the rail contact end 42 has a horizontal railhead contact surface 47. The same provision is made for the second pushover assembly 40' but is not displayed in the provided views. As can be seen in FIG. 1 a plurality of tieplate assemblies 50 secure the continuous rail 70, the railends 30 and 30' and the frame member 10 in relative positions to each other. FIGS. 2 and 3 reveal the details of the tieplate assemblies 50. A base plate 51 has upwardly extending beveled edge ridges 52 that are longitudinally extensive and upwardly extending rail holding ridges 53 that are also longitudinally extensive. Apertures 54 are formed in the base plate 51 between the beveled edge ridges 52 and the rail holding ridges 53. A locking plate 55 has a downwardly extending beveled edge ridge 56 and a horizontally extending contact surface 57 with an inner edge 58. The locking plate 55 is formed so that the downwardly extending beveled edge ridge 56 interfaces with the upwardly extending base plate beveled edge ridge 52 and so that a locking plate aperture 59 aligns with the base plate aperture 54.

FIG. 1 shows a central crosstie 60, central flanking crossties 61 and 61', end flanking crossties 62 and 62' and end crossties 63 and 63'. Also shown are a plurality of tieplate assembly lag screws 64 and a plurality of pushover assembly lag screws 65. Such crossties, being common to the industry, are not shown in other drawings.

FIG. 1 also shows a continuous rail 70. Because it is the common practice of the railroad industry to stagger rail joints it can be assumed that the continuous rail 70 has railends, not shown, which are equally distant from the crosstie 60. A first safety bolt assembly 80 and a second safety bolt assembly 80' are shown in FIG. 1 and both are of similar nature. In FIG. 3 it can be seen that a safety bolt 81 is provided a bolt head 82, large diameter threads 83, a bearing surface 84 and small diameter threads 85. As seen in FIGS. 3 and 4B a large diameter threaded aperture 86 is provided in the frame assembly outer wall 13 and a small diameter threaded aperture 87 is provided in the frame assembly inner wall 12. As seen in FIG. 5B a longitudinally extensive slot 88 having vertical bearing surfaces 89 is formed in the tongue member 20. Similar provisions are established in the walls 12' and 13' and the tongue member 20'. The safety bolt assemblies 80 and 80' permit longitudinal movement of the tongue members 20 and 20' within the frame member grooves 15 and 15' while reducing unwanted lateral movement.

Figure 6:
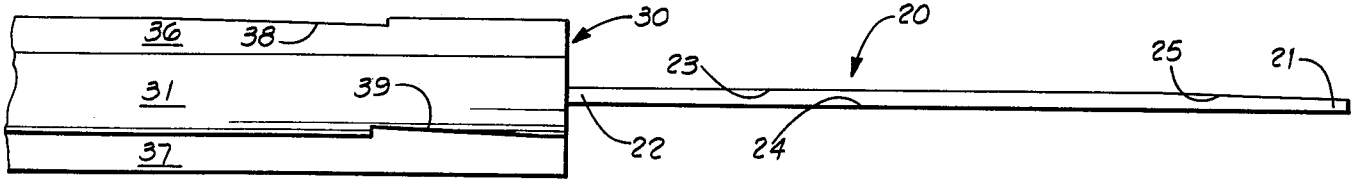
FIG. 6 is an isolated cross section end view of the electrical bondage assembly taken along the plane 6—6 as shown in FIG. 1.
Figure 5:
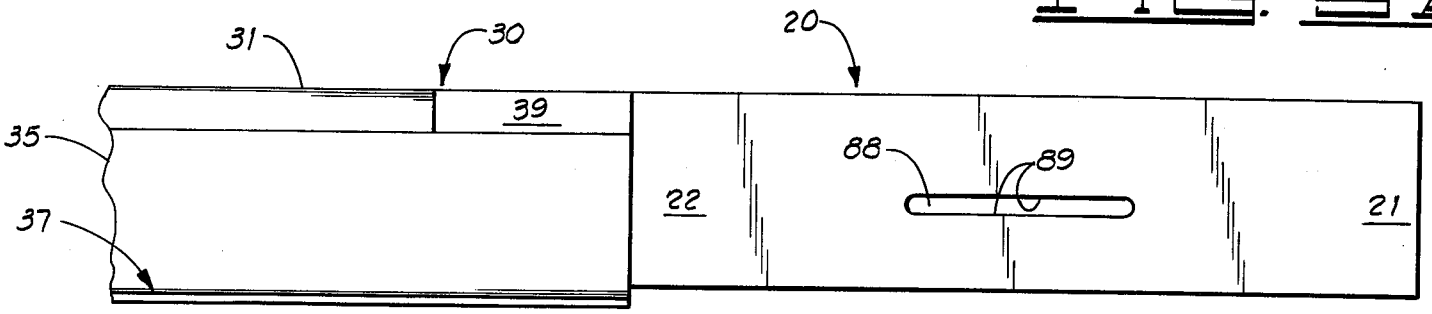
Figure 5:
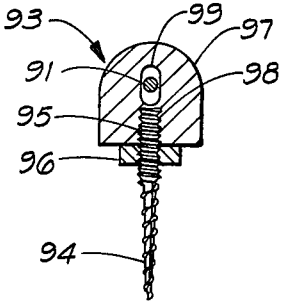

An electrical bondage assembly 90 is shown in FIG. 1 which is more specifically detailed in FIG. 6. An electrically conductive cable 91 has a cable first end 92 attached to the railend inner base flange 36 and a cable second end 92' attached to the railend inner base flange 36'. The cable 91 is horizontally supported above the surface by a plurality of standoff assemblies 93, each having a protrusive screw 94 with an upper threaded portion 95, a lock nut 96 and a cap 97. The cap 97 has a vertically extending threaded portion and a horizontal channel 99. Means for attachment of the cable ends 92 and 92' to the flanges 36 and 36' are conventional and therefor not shown.

Other customary features, such as the drain hole 100 can be provided without alteration of the inventive intent. Other apparatus, such as exemplified in my U.S. Pat. No. 4,260,105 for Railroad Tie Plate and Correctable Shim apparatus, can also be incorporated into the overall system without distraction. It is to be noted that the tieplate assemblies 50 have differing functions dependant upon location. As seen on crossties 60, 61, 61' the tieplate assemblies 50 fasten the continuous rail 70 and the opposite side frame member 10 so as to prohibit relative motion between those components. Coversely, on the crossties 62, 62', 63 and 63' the tieplate assemblies 50 fasten the railends 30 and 30' to permit longitudinal sliding. Achievement of the desired affect is established by the installation technique.

When, as seen in FIG. 3, the tieplate assembly lag screws 64 are tightened to a first position the locking plate 55 is bridged between the base plate beveled ridge 52 and the frame base flange 14. In such instance the horizontally extending contact surface 57 is in direct contact with the flange 14.

When, as seen in FIG. 2, the tieplate assembly lag screws 64 are tightened further than the first position the locking plate is bowed by contact with the railholding ridge and the contact surface inner edge 58 is moved vertically upward and out of contact with any other surface.

All railroad tracks, in one way or another, make provisions for longitudinal changes in the length of rail sections as the result of temperature changes. In some instances abutting rail ends are held in longitudinal alignment by side members and temperature changes dimensionally vary the longitudinal and lateral gap, which coincide. In this instance the longitudinal gap is divided and reduced because of the presence of the frame member central solid section 11. Additionally the lateral gap is divided into two reduced parts and longitudinally offset. The safety bolt assemblies 80 and 80' also provide very advantagious maintenance inspection points. Removal of the bolts 81 and 81' and inspection of the bearing surfaces 84 and 84' at established time intervals will evidence wear factors in the total track system which would not otherwise be visible.

Other maintenance inspection advantages are provided by the frame member deflective ramps 18 and 18' interfacing with the tongue member clearance ramps 25 and 25'. The interaction of these parts, in conjunction with the interfacing of the pushover vertical contact surfaces 47 and 47' and the railhead deflective ramps 39 and 39', establishes a wiping action within the frame grooves 15 and 15'. Burnishment patterns, or any lack thereof, will provide accumulative evidence of wear factors.

The pushover assembly vertical contact surfaces 47 and 47', interfacing with the lower railhead surfaces 34 and 34', prevent a reversed vertical stress load from being caused when an imposed work load is caused to move between crossties 61 and 62 or between crossties 61' and 62'. Without the vertical contact surfaces 47 and 47' the railends 30 and 30' would tend to bow downward over the crossties 62 and 62', thus exerting an upward stress at the end crossties 63 and 63'. The pushover assemblies 40 and 40', in conjunction with the frame member 10 and the tieplate assemblies 50 transfer the work load stresses over the plurality of crossties 60, 61, 61', 62, 62', 63 and 63' so as to keep such work load stresses to a level below the yield limit of the component parts.

The preferred means of attaching the first tongue member 20 to the first railend 30, and the second tongue member 20' to the second railend 30', is by welding but any other attachment means is acceptable as long as a rigid joint is formed. It is to be recognized that all of the vertical work load stresses are transferred to the tongue members 20 and 20' near the attachment ends 22 and 22' and that all of the vertical work load stresses are transferred to the frame member walls 12, 12', 13 and 13' near the tongue member free ends 21 and 21' and such loads are subsequently transferred to the frame central solid section 11 with no discontinuity of the horizontal work surface.

The longitudinal gap between the tongue member free ends 22 and 22' is essentially halved because of the frame member central solid section 11 presence. For essentially the same reason the lateral gap between the groove open ends 16 and 16', relative to the railends 30 and 30', is also halved. In addition the lateral gap is longitudinally displaced from that gap between the tongue member free ends 21 and 21' and the groove closed ends 17 and 17'.

When the various drawings are viewed in consideration of each other, and in conjunction with the written description given above, the operational sequence becomes self evident. It may be seen that each of the objectives cited in the Summary of the Invention section of this disclosure are achieved by this preferred embodiment.

What is claimed is:

1. A railraod track stress transfer apparatus, wherein longitudinally extensive parallel rails are placed on laterally extending crossties which are bedded in ballast placed on an earthen surface to form a track, comprising:

a frame member having a first and second pair of longitudinally extensive walls oppositely abutting a solid central portion vertically extending from a horizontal base flange forming first and second aligned grooves, each pair of walls comprising an outer wall and an inner wall;

a longitudinally extensive first tongue member having a free end and an attachment end configured to be slidably encompassed between the first pair of frame member walls with the first tongue member free end positioned longitudinally adjacent to, but spaced apart from, the frame member solid central portion;

a longitudinally extensive first rail end solidly connected to the attachment end of the first tongue member;

a longitudinally extensive second tongue member having a free end and an attachment end configured to be slidably encompassed between the second pair of frame member walls with the second tongue member free end positioned longitudinally adjacent to, but spaced apart from, the frame member solid central portion;

a longitudinally extensive second rail end solidly connected to the attachment end of the second tongue member;

said crossties being generally lateral to the longitudinal extensions of the frame member, the first and second tongue members and the first and second rail ends, and supportive thereof;

a plurality of tieplate assemblies equipped with tieplate lag screws defining means for rigidly fastening the frame member to appropriate crossties and securing said first and second rail ends to other crossties in a manner permitting longitudinal movement of the rail ends while restricting horizontal and vertical movement;

at least two pushover assemblies longitudinally displaced from said frame member, each having a thrust arm with a rail contact end configured to provide vertical and horizontal support to longitudinally slidable rail ends and a lower end joining a longitudinal extensive base bridgement plate equipped with lag screw means for rigidly fastening the base bridgement plates to the plurality of appropriate crossties, said pushover assemblies each defining means for laterally aligning one side of each said rail end with a respective side of said frame member, said aligning means comprising tapered means for moving each rail end laterally as said rail end moves longitudinally relative to said frame member; and safety bolt means horizontally insertable through the frame member walls with appropriate tongue member clearances for reducing lateral relative motion between the frame member walls while preserving longitudinal movement and limiting vertical movement of the tongue members.

2. The apparatus as cited in claim 1 in which the frame member walls are additionally characterized as comprising:

one of said inner walls being provided with a first deflective ramp adjacent to and abutting with the central solid section;

the other of said inner walls being provided with a second deflective ramp adjacent to and abutting with the central solid section so that longitudinal movement of the tongue members within the frame member grooves tends to react with the deflective ramp to establish a limited degree of lateral motion of the tongue members.

3. The apparatus as cited in claim 2 in which the longitudinally extensive tongue members are additionally characterized as comprising;

an inner surface of the first tongue member which is provided with, on the free end, a first clearance ramp; and an inner surface of the second tongue member which is provided with, on the free end, a second clearance ramp so as to increase the sliding contact area between the frame member deflective ramps and the tongue member clearance ramps and improve wear characteristics.

4. The apparatus as cited in claim 3 in which the rail ends are additionally characterized as comprising:

a first railhead outer vertical surface which is provided with a first railhead deflective ramp;

a first rail end inner base flange which is provided with a first clearance ramp;

a second railhead outer vertical surface which is provided with a second railhead deflective ramp; and a second rail end inner base flange which is provided with a second clearance ramp so that the rail contact end of the pushover assembly causes lateral movement to develop in the presence of rail end longitudinal movement.

5. The apparatus as cited in claim 4 in which said tapered means of said pushover assemblies are additionally characterized as comprising:

a rail contact end with a vertical contact surface angularly aligned with the rail head deflective ramp so as to increase the sliding contact area between the railhead deflective ramp and the rail contact end and improve wear characteristics.

6. The apparatus as cited in claim 5 wherein each of said outer frame member walls includes a large diameter threaded aperture, each of said inner frame member walls includes a small diameter threaded aperture, and said tongue member includes a slot, and the safety bolt assembly is additionally characterized as comprising:

a bolt member which is provided with a head, a large diameter thread adjacent to the head, a bearing surface adjacent to the large diameter thread and a small diameter thread adjacent to the bearing surface so that the bolt member can be inserted, without rotative motion, through the large diameter threaded aperture in the outer frame member wall, through the slot in the tongue member with such slot having vertical bearing surfaces and to a point of thread engagement where the small diameter threads engage with the small diameter threaded aperture of the frame member inner wall as the large diameter threads engage with the large diameter threaded aperture of the frame member outer wall and rotational motion of the bolt member secures the outer walls and inner walls together as the bolt bearing surface is brought into proximity with the tongue member slot bearing surface.

7. The apparatus as cited in claim 1, 2, 3, 4, 5 or 6 in which each tieplate assembly is characterized as comprising:

a base plate having upwardly extending and longitudinally extensive beveled edge ridges, parallel and upwardly extending rail holding ridges, and with the base plate vertically penetrated by apertures formed between each beveled edge ridge and the most adjacent rail holding ridge;

a locking plate having a downwardly extending and longitudinally extensive beveled edge ridge formed to interface with the base plate upwardly extending beveled edge ridge, a horizontally extending contact surface with an inner edge and with the locking plate vertically penetrated by apertures positioned to achieve vertical alignment with the base plate apertures; and tieplate assembly lag screws proportioned to pass vertically downward through the locking plate apertures and the base plate apertures for fastening engagement with the underlying crosstie so that the locking plate contact surface inner edge can be brought into locking engagement with, as appropriate, the frame member horizontal base flange or one of the rail end base flanges or, as appropriate, the lag screws can be torqued to bring the locking plate horizontal contact surface into contact with the base plate rail holding ridge with sufficient arcual deflection of the contact surface to adjustably release the inner edge of the contact surface from engagement with the rail flange in order to allow longitudinal movement of the rail end while preventing vertical or lateral movement and with the upwardly extending beveled edge of the base plate reacting with the downwardly extending beveled edge of the locking plate to create a lateral binding force between the apertures and the tie-plate assembly lag screw to retain the components is the selected position.

8. Apparatus for interconnecting longitudinally extensive and expandable railroad rails positioned end-to-end and adapted to be secured to laterally extending cross-ties, comprising:

each of said rails having at one end thereof a tapered tongue, said tongue having its maximum lateral dimension adjacent said respective rail end;

means for securing said rail ends in end-to-end alignment, said securing means including opposing tapered slot means correspondingly configured with said tapered tongues for receiving said tongues therein; and means, longitudinally displaced from said securing means and bearing against each rail in direction substantially normal to its longitudinal extent, for laterally aligning one side of each said rail with a respective side of said securing means, said aligning means comprising tapered means for moving each said rail laterally as said rail moves longitudinally relative to said securing means.

9. The apparatus of claim 8 wherein the taper of said tongue, said slot means and said moving means are proportionate.

10. The apparatus of claim 8, wherein each of said tapered tongues comprises blade means coextensive with said respective rail one end, said blade means being formed with an elongated opening therein; and said securing means includes pin means extending laterally across each said slot means and through said opening of each respective blade means, whereby longitudinal movement of each rail relative to said securing means is accommodated.

11. The apparatus of claim 10 wherein each said pin means comprises a shaft having two sets of threads separated by a non-threaded portion, said blade opening being slidably positioned on said non-threaded portion.

* * * * *